US006148752A

United States Patent [19]

Upmeyer

[11] Patent Number: 6,148,752

[45] Date of Patent: Nov. 21, 2000

[54] CARGO SHIP

[75] Inventor: Ulrich Upmeyer, Borgholzhausen, Germany

[73] Assignee: Westfalia-WST-Systemtechnik GmbH & Co. KG, Borgholzhausen, Germany

[21] Appl. No.: 09/355,100

[22] PCT Filed: Jan. 21, 1998

[86] PCT No.: PCT/EP98/00312

§ 371 Date: Jul. 23, 1999

§ 102(e) Date: Jul. 23, 1999

[87] PCT Pub. No.: WO98/32650

PCT Pub. Date: Jul. 30, 1998

[30] Foreign Application Priority Data

Jan. 23, 1997 [DE] Germany ..... 197 02 170

[51] Int. Cl.[7] ..... B63B 25/00

[52] U.S. Cl. ..... 114/72; 114/73

[58] Field of Search ..... 114/74 A, 72, 114/73, 125

[56] References Cited

U.S. PATENT DOCUMENTS 5,477,797 12/1995 Stuart ..... 114/125

FOREIGN PATENT DOCUMENTS 2 584 366 1/1987 France .
1 781 184 10/1970 Germany .
21 07 824 8/1972 Germany .
44 07 048 6/1995 Germany .

*Primary Examiner*—Stephen Avila
*Attorney, Agent, or Firm*—Browdy And Neimark

[57] ABSTRACT

The cargo ship (SL) as seagoing or inland waterway ship or pushed lighter, is fitted with a pallet high bay shelving system which has both sides of at least one bay row (RG) has a number of storage bays (cells) (1) placed either above one another or side for the pallets units, and has a drivable pallet vehicle (RFZ) to store and remove the pallet units (PE) in the bay rows (RG). The pallet vehicle (RFZ) is fitted with a vertical, central mast (2) on its chassis (3) and accommodates on one or both sides of the mast a satellite vehicle (4) capable of extending into or out of the storage bays (1) transversely to the travel direction (f) of the transversely or longitudinally propellable pallet vehicle (RFZ), and the satellite vehicles (4) can travel right up to the respective ship's side walls (5), and over them in the case of cargo space overbuilt to the outside (SL), for storage and removal of the pallet units (PE).

7 Claims, 3 Drawing Sheets

CARGO SHIP

CROSS REFERENCE TO RELATED APPLICATION

The present application is the national stage under 35 U.S.C. 371 of PCT/EP98/00312, filed Jan. 21, 1998.

BACKGROUND OF THE INVENTION

1. Technical Field of the Invention

The invention relates to a cargo ship as seagoing or inland waterways transport or as a pushed lighter for the transport of pallet units, with a high bay shelving palette storage system positioned in the cargo space, which on both sides of at least one bay row has a number of storage bays (cells) placed either above one another or side by side for the pallet units, and has a driveable pallet vehicle to store and remove the pallet units.

2. Object and Summary of the Invention

The aim of the invention is to effect the pallet vehicle for the storage and removal of pallets in such a way that it can make full use of the cargo space in the cargo ship without an overhead driveway and therefore space wastage.

To meet this aim the vehicle accommodates at least one satellite vehicle operating one or both-sided on its mast, which can store or remove pallet units at the same time or one side after the other in a transverse direction to that of the vehicle travel. The pallet vehicle forms a tandem transport apparatus with its two satellite vehicles which can travel right up to the cargo ship's side, and can therefore fully use the existing internal space, especially that required by European norms in pushed lighters—overhead driveway and travel loss are excluded. in order to make better use of cargo space the high bay shelving units can be displaced sideways, especially in ships (matching the ships contours).

These displaced high bay shelving units can be approached for storage and removal due to the pallet vehicle as in the invention, with its central mast and one or both sided hoisting gear functioning independently of each other, positioned in the direction of travel with integrated satellite stations. Here the different end-of-travel points for the bay handling apparatus must be taken into account for control purposes. In addition both satellite stations can only be driven by one hoist gear. In a similar way it is possible to reach sideways displaced shelving rows with a bay handling apparatus and a centrally positioned hoisting gear with both-sided travelling unit extendable in the vehicle travel directions especially telescopic units or transverse transport units on which a satellite station is positioned.

The bay handling apparatus can travel to the ship's side in both longitudinal or transverse directions; in the same way the travelling units or transverse transport units move in the bay handling apparatus travel direction, whereas storage and removal in or out of the storage bays with the satellite vehicle always takes place transversely to the bay handling apparatus travel direction.

A further aim of the invention is the avoidance of impact forces on the ship's side through the pallet vehicle or the pallet units themselves, this is solved by providing the ships sides with buffers which give way on impact with the pallet vehicle (chassis, traverses, satellite units and pallets) and absorb the force.

Furthermore the cargo ship is improved in terms of its draught, cargo cooling and accessibility, by the fitting out of hollow ship's side walls as water-floodable walls for weight increase, the possibilities for installing insulation and an upper-side catwalk construction.

A further aim is the optimal construction of an assembly, which is solved by provision of the storage area steel frame with roof and walls directly positioned on it, with thin internal walls forming stop-walls for the goods to be stored made of square tubing: and thin steel sheets both sides.

The whole cargo ship with pallet high bay shelving is fully usable for storage and removal of goods due to the use of the tandem pallet vehicle in its restricted goods storage area, wherein the vehicle avoids impact damage to the side walls during storage and removal in a simple manner, makes possible adjustment of the ship's draught and elementary cooling, and has a construction consisting of a reduced number of components with thin space-saving walls which secure stored goods.

BRIEF DESCRIPTION OF THE DRAWINGS

The diagrams show an example of the invention set-up, which will be described in detail below.

It shows.

Figure 1:
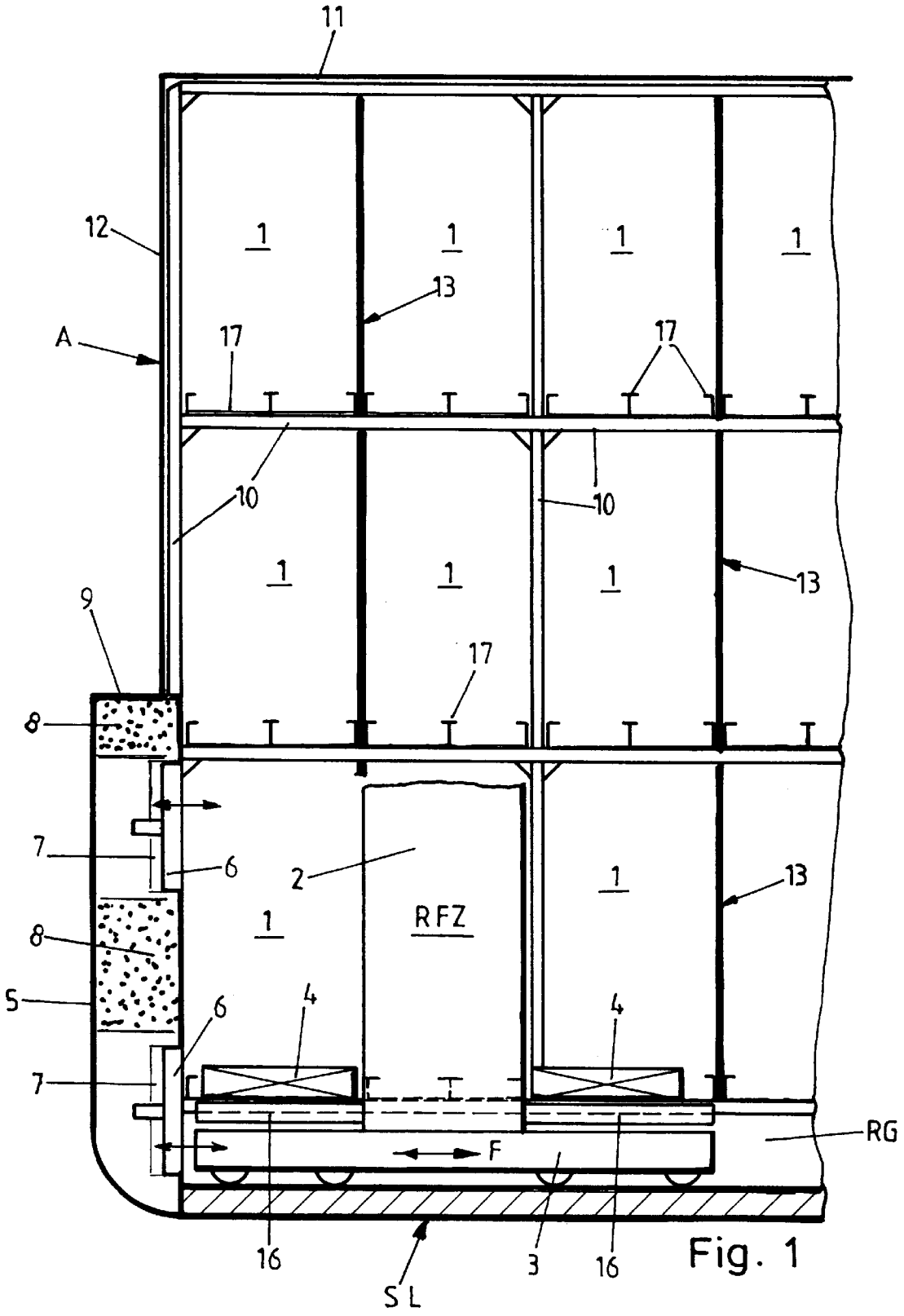
FIG. 1 a longitudinal section through a part of the cargo ship with the pallet high bay shelving, the pallet vehicle with two satellite vehicles with travel direction longitudinal to the ship and a floodable and insulatable hollow side wall including buffers, FIG. 2 a schematic cross section through the same cargo ship, FIG. 3 a plan view of a thin internal high bay shelving wall, FIG. 4 a schematic cross section through the cargo ship with pallet vehicle travelling in a transverse direction and the storage bays placed over the hollow side walls.

The cargo ship (SL) as seagoing or inland waterway ship, or pushed lighter, is fitted with a pallet high bay shelving system which has both sides of at least one bay row (RG) has a number of storage bays (cells) (1) for the pallet units placed either above one another or side by side, and has a driveable pallet vehicle (RFZ) to store and remove the pallet units (PE) in the bay rows (RG). The pallet vehicle (RFZ) carries a verticals central mast (2) on its motorised chassis (3) and accommodates on a transversely formed one or both-sided hoist gear (16) on at least one side of the mast, preferably on both mast sides opposite to one another, a extendable and retractable satellite vehicle (4) (satellite unit) movable to the pallet vehicle (RFZ) travel direction (F) in the storage bays (1) in the direction of the arrow (P). The pallet vehicle (RFZ) with the satellite vehicles (4) can travel right up to the ship's side walls (5) (storage location) for storage and removal of the pallet units (PE).

Figure 2:
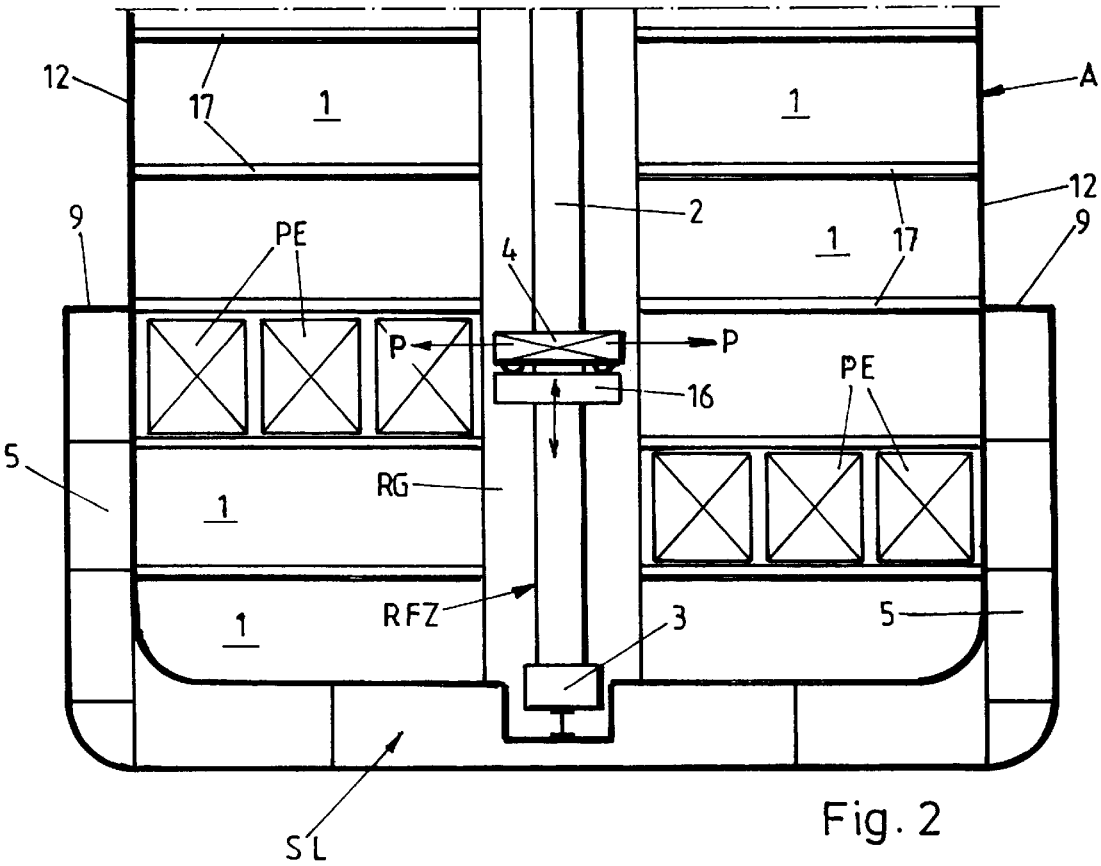

The side wall (5) as shown in FIGS. 1 and 2 is of hollow construction due to a hollow area (HR) formed towards the outside in the lower areas of the cargo space (SR), and the pallet vehicle (RFZ) travelling in the longitudinal ship's direction (F) can travel right up to the inside **(5*a*) of the hollow side wall (5) with its satellite vehicle (4), which can be seen in FIG. 1**.

Figure 4:
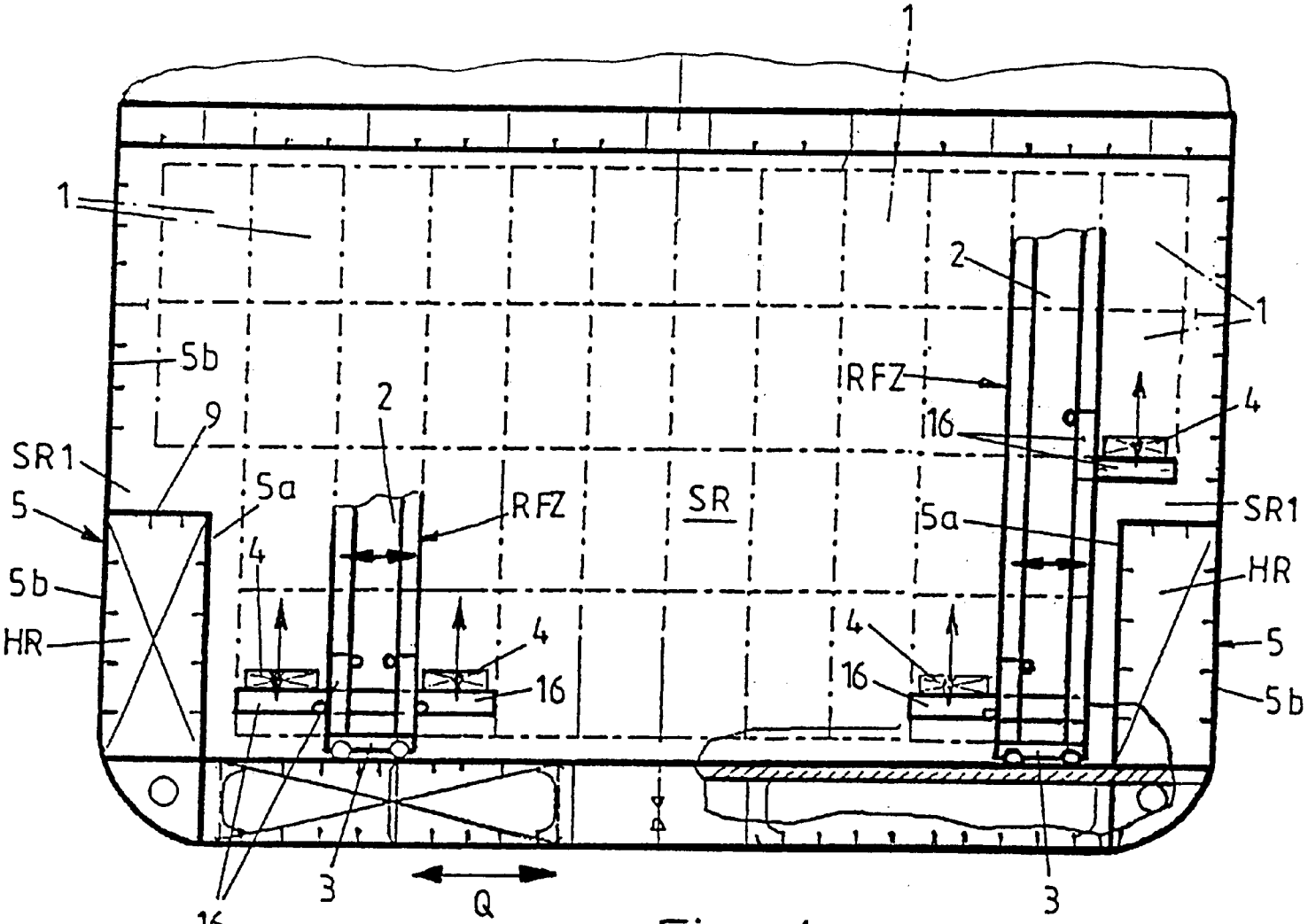

The side wall (5) as in FIG. 4 is of hollow construction due to a hollow area (HR) formed towards the inside in the lower areas of the ship and this hollow area (HR) provides a stepped cargo space (SR) in the lower areas of the ship. The pallet vehicle (RFZ) travelling in the transverse ship's direction (Q) travels first up to the vertical inner side **(5*a*) of the hollow side wall (5) and then above the hollow area (HR) in the cargo space (SR1) positioned above set (SR) to the outside, up to the side wall (5) vertical outer side (5*b*)** connected to the hollow area (HR) for storage and removal of pallet units (PE).

In FIG. 4 the pallet vehicle (RFZ) in the left-hand side of the diagram has travelled with its satellite vehicle (4) up to the inside (5*a*) of the hollow side wall (5), and in the storage bays (1) in the lower area positioned between the hollow areas (HR) pallet units (PE) are being stored or removed; the chassis (3) is at present in this position at a distance from the side wall (5) and the mast (2) is near the storage bays (1) in front of the storage bays (1) which are on the side wall side in rows above one another.

In the right-hand side of FIG. 4 the right-hand satellite vehicle (4) has been hoisted up the mast (2), and the chassis (3) has been driven close up to the inside (5*a*) of the hallow side wall (5), so that the storage bays (1) positioned above the hollow area (HR) can be worked for the storage and removal of pallet units (PE). Here the chassis (3) is standing close to the inner hollow area wall side (5*a*) and the satellite vehicle (4) is projecting towards the outside above the hollow area (HR).

A hoist gear (16) capable of accepting a satellite vehicle (4) is on one or both opposite mast sides on the vertical mast (2) and has been set in position by motorised vertical propulsion. In the case of the installation of two hoist gears (16) these could be vertically propelled singly or together.

The satellite vehicles (4) are also driven close up to the vertical inner side wall side (5*a*) and upwards over the construction wall (12) running in a vertically extended direction with its transversely positioned hoist gear (16). In FIG. 4 the satellite vehicles (4) with their transversely positioned hoist gear (16) in the lower ship area have been driven up to the vertical inner side wall side (5*a*) and then upwards through further chassis (3) movement to the hollow area (HR), over the hollow area (HR) up to the outer side wall (5*b*) extended upwards.

Both pallet vehicles (RFZ) are constructed identically, but with differing chassis lengths, and work identically, on the one side in the ship's longitudinal direction and on the other side in the ship's transverse direction, whereby the pallet storage and removal is always carried out transversely to the pallet vehicle (RFZ) travel direction (F, Q).

In FIG. 1 there are sufficient buffers (6) provided in the hollow side walls (5) for pallet vehicle (RFZ) travel impact. These buffers (6) are adjustable in guides (7) on the side walls (5) in and opposite to the pallet vehicle travel direction (F) and impact is absorbed by pressurised cylinders, springs or the like.

The hollow side walls (5) are also, as in FIGS. 1 and 2, are constructed as floodable walls so as to allow entry of water to adjust the ship's draught and to allow installation of insulation (8), and form a catwalk (9) on their upper side.

The high bay shelving directly supports the roof (11) and walls (12) of a pushed lighter construction with its steel frame (10).

Figure 3:
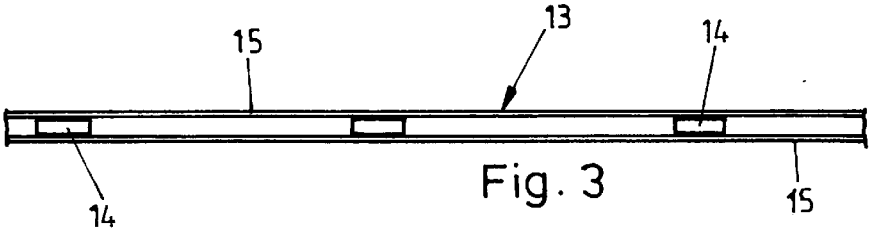

As shown in FIG. 3, the high bay shelving shows thin, closed internal walls (13) made of square tubing (14) and flat or slightly profiled steel plates (15) positioned on both sides of the tubing, whereby the plates (15) form stop-walls for the stored goods.

These internal walls (13) form boundaries for the storage bays (1); furthermore these internal walls (13) stabilise the whole high bay shelving hull composed of the steel frame (10) and walling (11, 12).

Each of the storage bays (1) divided by the steel frame (10) and the internal walls (13) shows a fluted support and travel guide (17), in which the satellite vehicles (4) with the pallet units (PE) can travel and on which the pallet units (PE) can be stowed.

The pallet vehicle (RFZ) is constructed in a similar manner in both longitudinal and transverse directions apart from the chassis length, and is constructed to work in both directions.

What is claimed is:

1. A cargo ship for the transport of pallet units having, a high bay shelving palette storage system positioned in a cargo space, a plurality of storage bays (cells) placed either above one another or side by side for receiving the pallet units on both sides of at least one bay row, and a drivable pallet vehicle to store and remove the pallet units having at least one satellite vehicle (4) working on one or both sides of the vehicle, the satellite vehicle traveling into and out of the storage bays (1) transversely to a travel direction (F, Q) of the pallet vehicle (RFZ) from a mast (2) fixed to a chassis (16) of the vehicle, wherein the satellite vehicle(s) (4) can travel to an appropriate storage position for storage or removal of the pallet units (PE);

wherein side walls (5) in lower areas of the ship are of hollow construction due to the addition of a hollow area (HR) to an inside of the side walls, the hollow area (HR) producing a stepped cargo space (SR) in the lower areas of the ship, wherein the pallet vehicle (RFZ) traveling in a transverse direction of the ship travels up to a vertical inner side (5*a*) of one of the side walls and then above the hollow area (HR) into an above-positioned cargo space (SR1) set to an outside of the ship, and up to the side wall (5) vertical outer side (5*b*) connected to the hollow area (HR) to permit storage and removal of pallet units (PE) by the satellite vehicle (4).

2. Cargo ship according to claim 1, further comprising:

a hoist gear (16) capable of accepting the satellite vehicle (4) is on one or both opposite mast sides of the vertical mast (2) and is set in position by motorized vertical propulsion, and that both hoist gears (16) can be vertically propelled singly or together.

3. Cargo ship according to claim 1, wherein the hollow side walls (5) have built-in buffers (6) for the impacting pallet vehicle (RFZ).

4. Cargo ship according to claim 1, wherein the hollow side walls (5) are constructed as floodable walls so as to allow entry of water to adjust the draught of the ship and to allow installation of insulation (8), and form a catwalk (9) on their upper side.

5. Cargo ship according to claim 1, wherein the high bay shelving supports a roof (11) walls (12) of a construction (A) within the cargo ship with a steel frame (10).

6. Cargo ship according to claim 1, wherein the high bay shelving storage system has thin, closed internal walls (13) made of square tubing (14) and flat or slightly profiled steel plates (15) positioned on both sides of the tubing, whereby the plates (15) form stop-walls for the stored goods and stabilize a whole high bay shelving hull (10, 11, 12).

7. Cargo ship according to claim 1, wherein the pallet vehicle (RFZ) has traverses (16) for longitudinal and transversely propellable satellite units (4) in longitudinal and transverse directions on the central mast (2).

* * * * *